US006918361B2

(12) United States Patent
Diehl et al.

(10) Patent No.: US 6,918,361 B2
(45) Date of Patent: Jul. 19, 2005

(54) DEVICE FOR CONTROLLING A CROSS-SECTION OF AN OPENING IN THE COMBUSTION CYLINDER OF AN INTERNAL COMBUSTION ENGINE

(75) Inventors: Udo Diehl, Stuttgart (DE); Bernd Rosenau, Tamm (DE); Simon Kieser, Sachsenheim (DE); Uwe Hammer, Hemmingen (DE); Volker Beuche, Stuttgart (DE); Stefan Reimer, Markgroeningen (DE); Peter Lang, Weisach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/451,286

(22) PCT Filed: Nov. 28, 2002

(86) PCT No.: PCT/DE02/04369

§ 371 (c)(1),
(2), (4) Date: Dec. 5, 2003

(87) PCT Pub. No.: WO03/060293

PCT Pub. Date: Jul. 24, 2003

(65) Prior Publication Data

US 2004/0083995 A1 May 6, 2004

(30) Foreign Application Priority Data

Jan. 15, 2002 (DE) ..... 102 01 167

(51) Int. Cl.[7] ..... F01L 9/34

(52) U.S. Cl. ..... 123/90.12; 123/90.15

(58) Field of Search ..... 123/90.12, 90.13, 123/90.15, 90.48, 90.49

(56) References Cited

U.S. PATENT DOCUMENTS 4,889,085 A * 12/1989 Yagi et al. ..... 123/90.12

FOREIGN PATENT DOCUMENTS

DE 198 26 047 12/1999

* cited by examiner

*Primary Examiner*—Thomas Denion
(74) *Attorney, Agent, or Firm*—Kenyon & Kenyon

(57) ABSTRACT

A device for controlling an opening cross section in the combustion cylinder of an internal combustion engine is provided, the device having a gas exchange valve integrated into the combustion cylinder and having an actuator which drives the valve element to execute a closing stroke and an opening stroke. A valve brake which is active during a residual closing stroke of the valve element is provided for the purpose of reducing the impact velocity of the valve closure member of the valve element on the valve seat in the closing stroke of the valve element. The valve brake has a hydraulic damping element with a fluid displacement volume which flows out through a throttle cross section of a throttle opening, and a control unit for controlling the throttle cross section as a function of the viscosity of the displacement volume.

27 Claims, 5 Drawing Sheets

DEVICE FOR CONTROLLING A CROSS-SECTION OF AN OPENING IN THE COMBUSTION CYLINDER OF AN INTERNAL COMBUSTION ENGINE

FIELD OF THE INVENTION

The present invention relates to a device for controlling an opening cross section in a combustion cylinder of an internal combustion engine.

BACKGROUND INFORMATION

A device of this type, i.e., a device for controlling an opening cross section in a combustion cylinder, is disclosed in published German Patent Application No. 198 26 047. This device has a double-acting hydraulic working cylinder as the actuator, i.e., valve actuator; an actuating piston which is axially displaceably guided in this working cylinder is fixedly connected to the valve shaft of the gas exchange valve that is integrated into the combustion cylinder or it forms the end thereof, which is remote from the valve closure member. With its two end faces which face away from one another, the actuating piston delimits a first and second pressure chamber in the working cylinder. While the first pressure chamber through which a piston displacement in the direction of valve closing is induced is constantly acted upon by fluid under pressure, the second pressure chamber through which a piston displacement is induced in the direction of valve opening is acted upon with fluid under pressure in a controlled manner with the help of control valves, preferably 2/2-way solenoid valves, or the pressure is relieved to approximately ambient pressure. The fluid under pressure is supplied by a regulated pressure supply. A first control valve connects the second pressure chamber to the pressure supply and a second control valve connects the second pressure chamber to a relief line opening into a fluid reservoir. In the closed state of the gas exchange valve, the second pressure chamber is separated from the pressure supply by the first control valve, which is closed, and is connected to the relief line through the second control valve, which is opened, so that the actuating piston is displaced into its closed position by the fluid pressure prevailing in the first pressure chamber. For opening the gas exchange valve, the control valves are switched over, so that the second pressure chamber is cut off from the relief line and is connected to the pressure supply. The gas exchange valve opens because the piston face of the actuating piston is larger in the second pressure chamber than the effective area of the actuating piston in the first pressure chamber, the length of the opening stroke depending on the formation of the electric control signal applied to the first control valve, and the opening speed depends on the fluid pressure, which is controlled by the pressure supply. To close the gas exchange valve, the control valves are switched over again, whereby the second pressure chamber, which is cut off from the pressure supply, is connected to the relief line, and the fluid pressure prevailing in the first pressure chamber returns the actuating piston to its valve closure position, so that the gas exchange valve is closed by the actuating piston.

With a device such as the one described above, there is a need for rapid closing of the gas exchange valve, and at the same time, a low impact velocity of the valve closure member on the valve seat, which must not exceed certain limit values for reasons of noise level and wear.

SUMMARY OF THE INVENTION

The device according to the present invention for controlling an opening cross section in a combustion cylinder of an internal combustion engine has the advantage that the valve element is braked sharply in the closing stroke before reaching its closed position, the braking effect being independent of the temperature or the related viscosity of the fluid volume displaced through the throttle cross section. The throttle cross section is decreased when there is a rise in temperature and thus a decrease in viscosity, so the flow velocity of the displaced fluid volume through the throttle and thus the braking effect of the damping element remain approximately constant.

According to an exemplary embodiment of the present invention, the damping element has a damping cylinder, a damping piston fixedly connected to the lifting motion of the valve element and axially displaceable in the damping cylinder, and a volume displacement chamber which receives the fluid displacement volume and is delimited by the damping piston, this volume displacement chamber communicating with the throttle opening, the damping element preferably being integrated into the actuator, so that the damping piston is formed by the actuating piston itself when the actuator is designed as a double-acting working cylinder having an actuating piston.

According to an exemplary embodiment of the present invention, the control unit for controlling the throttle cross section has a control piston protruding into the volume displacement chamber and a throttle piston which influences the throttle cross section of the throttle opening, the throttle piston being connected to the control piston so that the throttle cross section increases with an increase in displacement of the control piston from the volume displacement chamber. The control piston and the throttle piston are coordinated so that at the operating temperature of the fluid, the throttle cross section is such that the fluid volume displaced by the damping piston out of the volume displacement chamber in the closing stroke of the valve element flows through the throttle cross section at a predetermined flow velocity. This design of the throttle cross section minimizes the regulating operations required for the throttle piston in normal operation. The throttle cross section is understood to refer to the effective portion of the throttle opening, i.e., the portion available for fluid flow at a given point in time.

According to an exemplary embodiment of the present invention, the control piston is acted upon by a spring force of a restoring spring which counteracts the displacement direction of the control piston out of the volume displacement chamber. Due to this restoring spring acting as a spring energy accumulator, a portion of the braking energy may be recovered and subsequently used to accelerate the valve element in the direction of valve opening. It is possible in this way to either reduce the diameter of the actuating piston in the actuator driving the valve element or to reduce the hydraulic supply pressure for the actuator so that the overall energy efficiency of the system is improved.

According to an alternative exemplary embodiment of the present invention, the throttle opening is situated in a chamber wall of the volume displacement chamber, and the control unit for controlling the throttle cross section of the throttle opening has a throttle slide which is displaceable along the throttle opening by a gas volume that is exposed to the fluid temperature of the displacement volume, so that the throttle cross section of the throttle opening is reduced in a displacement direction induced by the increase in gas volume. Therefore, a guide bore extending across the volume displacement chamber intersects the volume displacement chamber in such a way as to create the throttle opening in the chamber wall of the volume displacement chamber.

The throttle slide having a circular cross section is axially displaceably situated in the guide bore and has at least one through hole which extends across the axis of the slide and may be pushed beyond the throttle opening.

According to an exemplary embodiment of the present invention, the gas volume for actuating the throttle slide is enclosed in a container which communicates in a thermally conducting manner with the volume displacement chamber and has an elastically expandable or displaceable container wall, preferably a diaphragm, which is fixedly attached to the throttle slide. Due to this measure, the control device may be implemented quite favorably in terms of the manufacturing technology, and the response characteristics of the control device may be supported by additional heating of the gas volume.

According to an exemplary embodiment of the present invention, the control unit has a pressure-controlled throttle element which varies the throttle cross section of the throttle opening, an electrically controlled hydraulic pressure valve which adjusts the control pressure on the throttle valve, and an electronic control unit which triggers the pressure valve and generates control signals for the pressure valve as a function of the viscosity of the displacement volume. When there are multiple gas exchange valves in the internal combustion engine, the braking effect on all gas exchange valves may be adjusted jointly in a simple manner by using one pressure-controlled throttle for each gas exchange valve and by jointly adjusting the pressure on all the pressure-controlled throttles.

According to an exemplary embodiment of the present invention, a viscosity sensor which measures the viscosity of the displacement volume is provided, its measurement signals being sent to the control unit. A first characteristic curve, which describes the functional relationship between the throttle cross section and the hydraulic control pressure on the throttle element, is stored in the control unit along with a second characteristic curve, which describes the functional relationship between the viscosity and the hydraulic control pressure. On the basis of these two stored characteristic curves, the control unit generates the control signals for the pressure valve.

In an alternative exemplary embodiment of the present invention, instead of a viscosity sensor, a temperature sensor which measures the temperature of the displacement volume may be used, its measurement signals in turn being sent to the control unit. A third characteristic curve which describes the functional dependence of the viscosity of the fluid used on the temperature is stored in the control unit. In this case, the control signals for the pressure valve are generated on the basis of all three characteristic curves.

DETAILED DESCRIPTION

Figure 1:
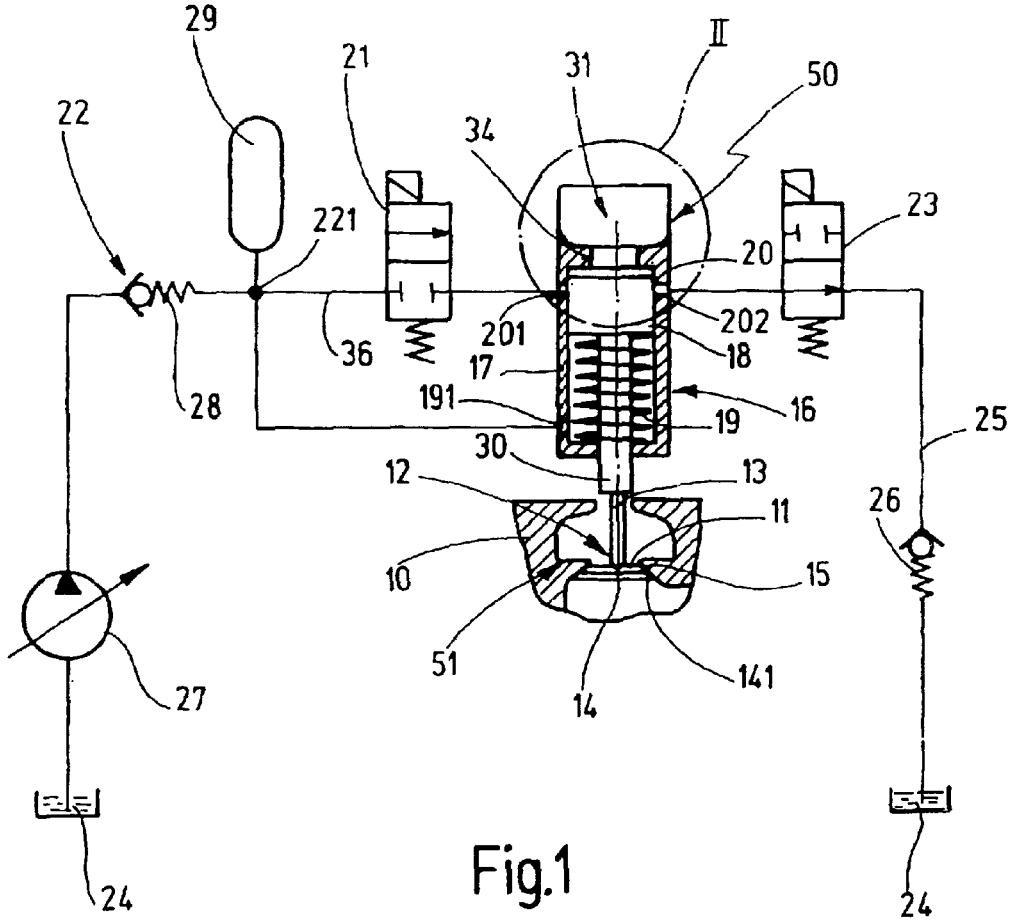
FIG. 1 shows a diagram of a device for controlling an opening cross section in a combustion cylinder of an internal combustion engine.

The device shown in the diagram in FIG. 1 for controlling an opening cross section 11 in a combustion cylinder 10 of an internal combustion engine in a motor vehicle has a gas exchange valve 51, which is integrated into combustion cylinder 10 and has an axially displaceable valve element 12 including a valve shaft 13 and a valve closure member 14 on the end of valve shaft 13. Valve closure member 14 cooperates with a valve seat 15 surrounding opening cross section 11, valve closure member 14 resting on the valve seat with a valve sealing face 141 in the closed position of gas exchange valve 10, thereby sealing the opening cross section 11 in a gastight manner.

For actuating the lift of valve element 12, the device has a hydraulically operated valve actuating element, referred to below as actuator 16, which is a double-acting working cylinder, including a cylinder housing 17 and an actuating piston 18 which is guided so it is axially displaceable in cylinder housing 17 and delimits a lower first pressure chamber 19 and an upper second pressure chamber 20 in cylinder housing 17. First pressure chamber 19 is directly connected to a fluid connection 191, and second pressure chamber 20 is connected to a fluid connection 201 via first control valve 21 at outlet 221 of a regulatable pressure supply device 22. Second pressure chamber 20 is also connected to a fluid connection 202 via a second control valve 23 on a return line 25 opening into a fluid reservoir 24, and a non-return valve 26 may additionally be provided in this return line. Control valves 21, 23 are designed as 2/2-way solenoid valves having spring recoil. Pressure supply device 22 includes a high-pressure pump 27, which is preferably regulatable and conveys a fluid, preferably hydraulic oil, out of fluid reservoir 24, a non-return valve 28 and a pressure accumulator 29 for pulsation damping and energy storage. Actuating piston 18 is rigidly connected to valve shaft 13 of gas exchange valve 51 by a piston rod 30, which protrudes out of cylinder housing 17. As an alternative, actuating piston 18 may also be designed to sit directly on valve shaft 13.

As shown in FIG. 1, first control valve 21 is closed and second control valve 23 is open. The high pressure prevailing in first pressure chamber 19 ensures that actuating piston 18 is at top dead center and therefore valve closure member 14 is pressed with its valve closure face 141 onto valve seat 15 forming a gastight seal, i.e., a gastight closure of opening cross section 11. When control valves 21, 23 are switched over, second pressure chamber 20 is cut off from return line 25 and the high pressure at outlet 221 of pressure supply device 22 is applied to second pressure chamber 20. The area of actuating piston 18 delimiting second pressure chamber 20 is greater than the area of actuating piston 18 delimiting first pressure chamber 19, so that actuating piston 18 moves downward in FIG. 1 and valve closure member 14 of valve element 12 is lifted up from valve seat 15, thereby opening the opening cross section 11. To close gas exchange valve 51, control valves 21, 23 are returned to the switching position shown in FIG. 1. Therefore, second pressure chamber 20 is connected to return line 25 and is pressureless. Actuating piston 18 moves upward in FIG. 1 and positions valve body 14 of valve element 12 on valve seat 15, thereby sealing the opening cross section 11.

In the case of gas exchange valves for internal combustion engines, there is a need for rapid closing and at the same time a low impact velocity of the valve closure member on the valve seat, which must not exceed certain limit values for reasons pertaining to wear and noise level, in particular when they are used as intake valves. To comply with these limit values, a valve brake 50 is provided. Valve brake 50 has a hydraulic damping element 31, having a fluid displacement volume flowing out through a throttle cross section of a throttle opening 35 (FIGS. 2 and 3), and a control unit 49 for controlling the throttle cross section as a function of the viscosity of the displacement volume. Throttle cross section here is understood to refer to the portion of throttle opening 35 which is opened for fluid flow through it. Control unit 49 is designed so that with a decrease in the viscosity of the displacement volume, the throttle cross section of the throttle opening is decreased.

Figure 2:
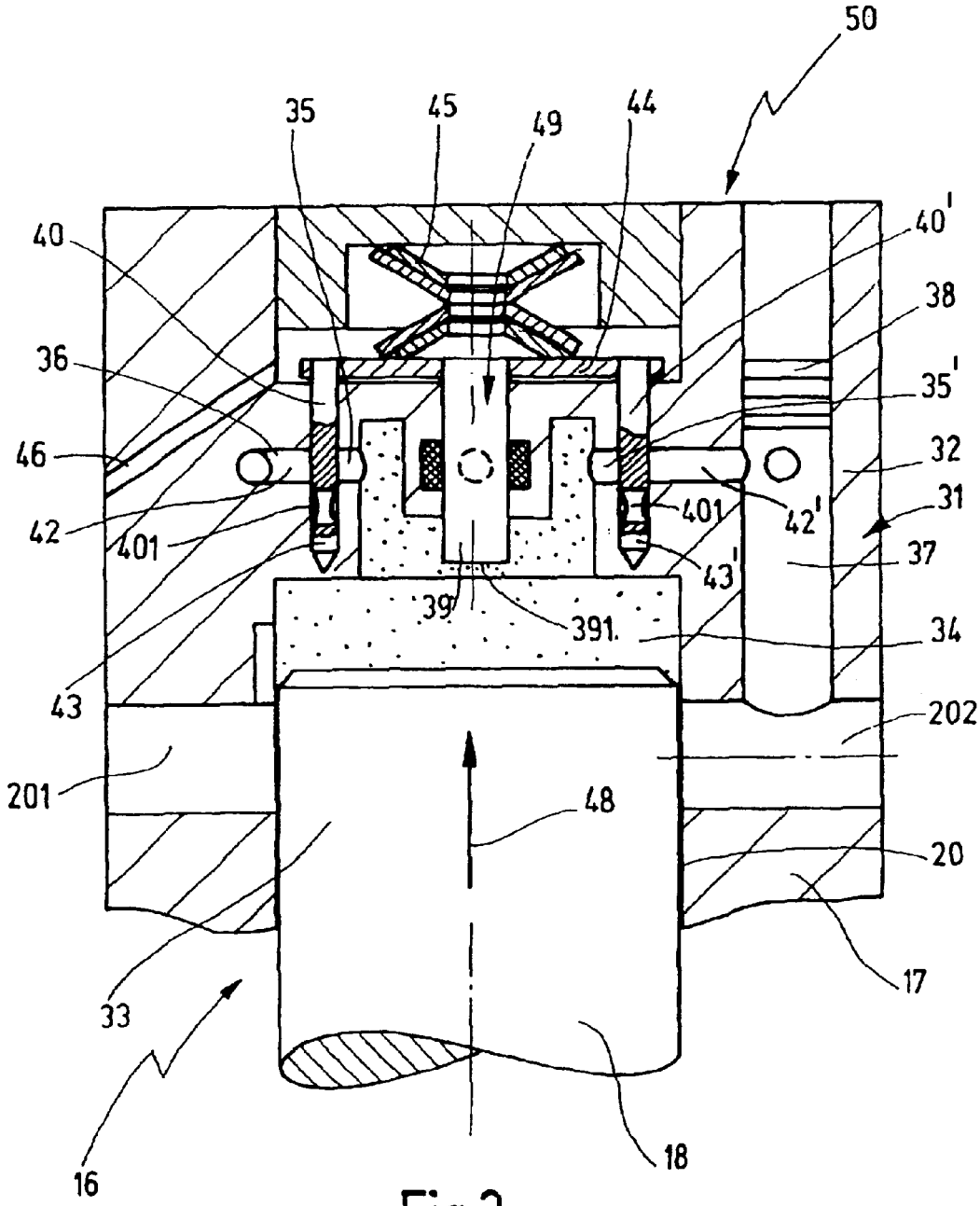
FIG. 2 shows an enlarged cross-sectional diagram of section II in FIG. 1.

In the exemplary embodiment of valve brake 50 shown in FIGS. 1 and 2, damping element 31 and control unit 49 are integrated into actuator 16. Damping element 31 has a damping cylinder 32, which is connected in one piece to cylinder housing 17 of actuator 16, a damping piston 33, which is designed in one piece with actuating piston 18 of actuator 16, is axially displaceable in damping cylinder 32 and is linked to the lifting movement of valve element 12; the damping element also has a volume displacement chamber 34, which is connected to second pressure chamber 20 to allow a fluid exchange. As shown in FIG. 2, volume displacement chamber 34 communicates with at least one throttle opening 35. Damping piston 33, which is combined with actuating piston 18 of actuator 16, is designed so that it seals fluid connection 202 of second pressure chamber 20 to return line 25 at least temporarily after a predetermined closing stroke of valve element 12. The fluid volume displaced out of volume displacement chamber 34 through the throttle cross section of throttle opening 35 after further movement of damping piston 33 in the direction of arrow 48 is sent through corresponding bores in damping cylinder 32 to fluid connection 202, which is connected to return line 25, namely downstream from its opening into second pressure chamber 20. The bores provided for this purpose in damping cylinder 32 are labeled as 36 and 37 in FIG. 2. Axial bore 37 is closed with a sealing piece 38 above the end of radial bore 36.

Control unit 49 has a control piston 39, which is axially displaceably guided in damping cylinder 32, projects into volume displacement chamber 34 and is sealed by a ring gasket 41 with respect to volume displacement chamber 34, and a throttle pin 40, which influences the throttle cross section of throttle opening 35 and is connected to control piston 39 in such a way that the throttle cross section is increased with-an increase in the displacement of control piston 39 out of volume displacement chamber 34. Piston area 391 of control piston 39 protruding into volume displacement chamber 34 and the design of throttle pin 40 are mutually coordinated so that the size of the throttle cross section of throttle opening 35, which is controlled by throttle pin 40 at the operating temperature of the fluid, is such that the fluid volume displaced of volume displacement chamber 34 by displacement piston 33 with the closing stroke of valve element 12 flows through the throttle cross section of throttle opening 35 at a predetermined flow velocity.

Throttle opening 35 is formed by an outlet bore 42 which opens into volume displacement chamber 34 and has a guide bore 43 passing through it transversally. Throttle piston 40 is axially displaceably accommodated in guide bore 43. Throttle piston 40 has a transverse bore 401 which passes through throttle body 40 and is insertable into the intersection area of outlet bore 42 and guide bore 43. The diameter of transverse bore 401 corresponds approximately to the diameter of outlet bore 42. If transverse bore 401 is outside the intersection area, throttle opening 35 is completely closed by throttle valve 40, and with increasing insertion of transverse bore 401 into outlet bore 42, the throttle cross section of throttle opening 35 is enlarged continuously. Throttle pin 40 is adjusted by control piston 39 as a function of the compressive force acting on control piston 39.

In the exemplary embodiment shown in FIG. 2, volume displacement chamber 34 communicates with a second throttle opening 35' which is implemented in the same way with the help of an outlet bore 42' which in turn has a guide bore 43' passing through it, another throttle piston 40' having a transverse bore 401' being axially displaceably guided in this guide bore. Transverse bore 401' is situated with an offset with respect to transverse bore 401 in throttle pin 40 so that it opens a throttle cross section of throttle opening 35' only at a greater stroke of throttle piston 40'. Both throttle pistons 40, 40' and control piston 39 are aligned in parallel to one another and are rigidly joined by a crossarm 44. A restoring spring 45 is supported on crossarm 44 and acts upon control piston 39 with a spring force acting in the direction opposite that of the displacement of control piston 39 out of volume displacement chamber 34. In the exemplary embodiment shown in FIG. 2, restoring spring 45 is formed by a plurality of disk springs combined into a stack. Due to this restoring spring 45, which constitutes a spring energy accumulator, a portion of the braking energy absorbed by valve brake 50 is recoverable and may be subsequently used to accelerate valve element 12 in the direction of valve opening.

An exemplary operation of valve brake 50 is described below.

After sealing the fluid connection 202 in actuator 16 by damping piston 33, which is connected to actuator piston 18 in the stroke of actuator piston 18 in the direction of closing of gas exchange valve 51, the pressure in volume displacement chamber 34 increases due to the upward movement of the piston in the direction of arrow 48 because the fluid volume able to flow out at throttle opening 35 is less than the volume replenished by damping piston 33. If the pressure in volume displacement chamber 34 increases further, control piston 39 is displaced upward by the pressure acting on its piston face 391, thereby displacing throttle pins 40' and 41'. Therefore, transverse bore 401 and transverse bore 401' (with an offset) are inserted further into outlet bore 42 and 42', respectively, and the cross section of throttle opening 35 is increased. The design point of the throttle cross section is the operating temperature for minimizing the regulating processes in normal operation. If the operating temperature has not yet been reached, the pressure in volume displacement chamber 34 increases, as described above, so that the throttle cross section is increased, and the fluid having the greater viscosity is able to flow out through the enlarged throttle cross section at the same flow velocity as the fluid that has been heated to the operating temperature and has a lower viscosity accordingly. Leakage through control piston 309 and throttle pins 40, 40' is removed through a leakage bore 46 introduced into damping cylinder 32.

Figure 3:
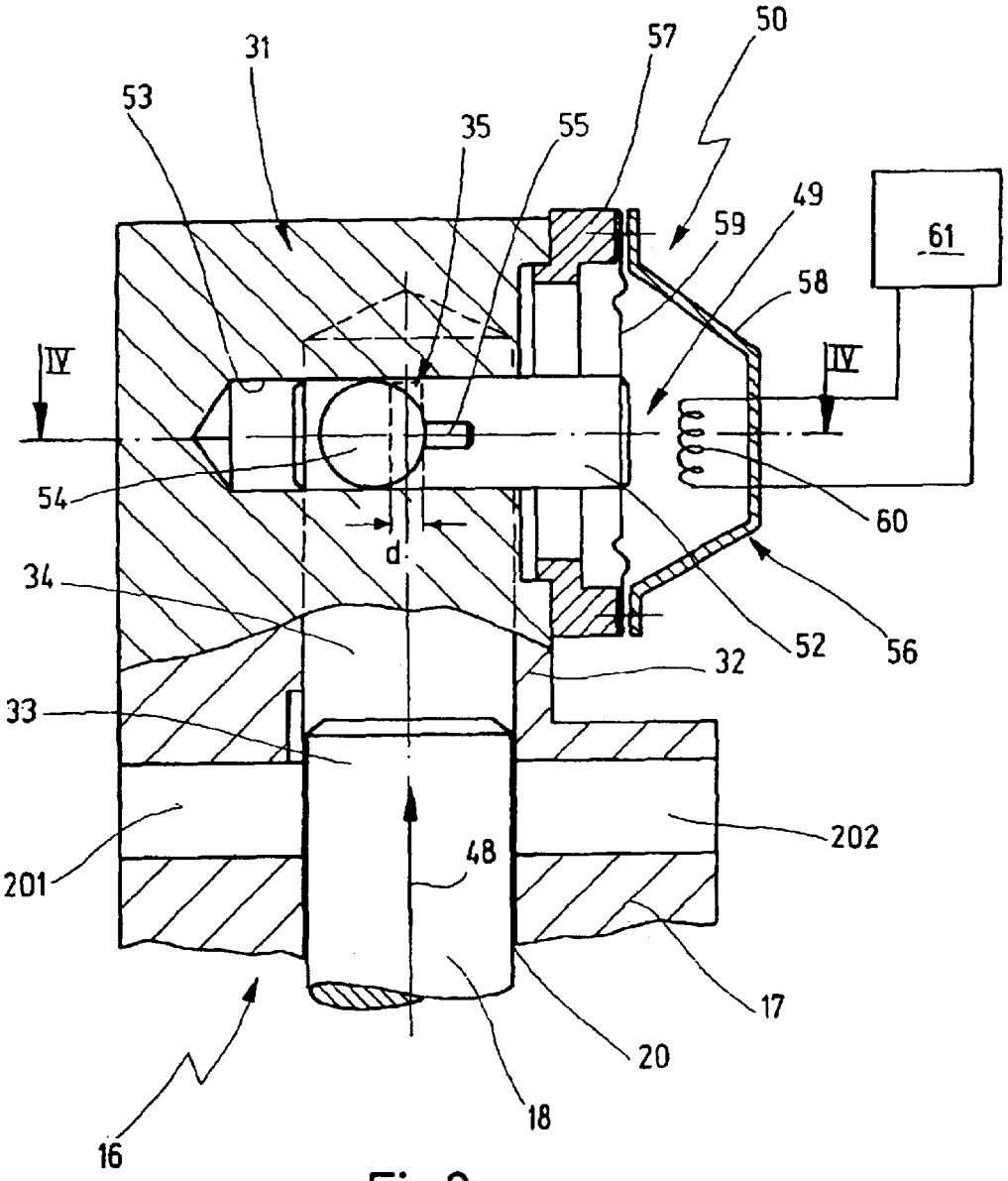
FIG. 3 shows an enlarged cross-sectional diagram of a modified exemplary embodiment of section II in FIG. 1, an upper section of which corresponds to a section taken along line $III_O$—$III_O$ in FIG. 4 and a lower section of which corresponds to a section taken along line $III_U$—$III_U$ in FIG. 4.
Figure 4:
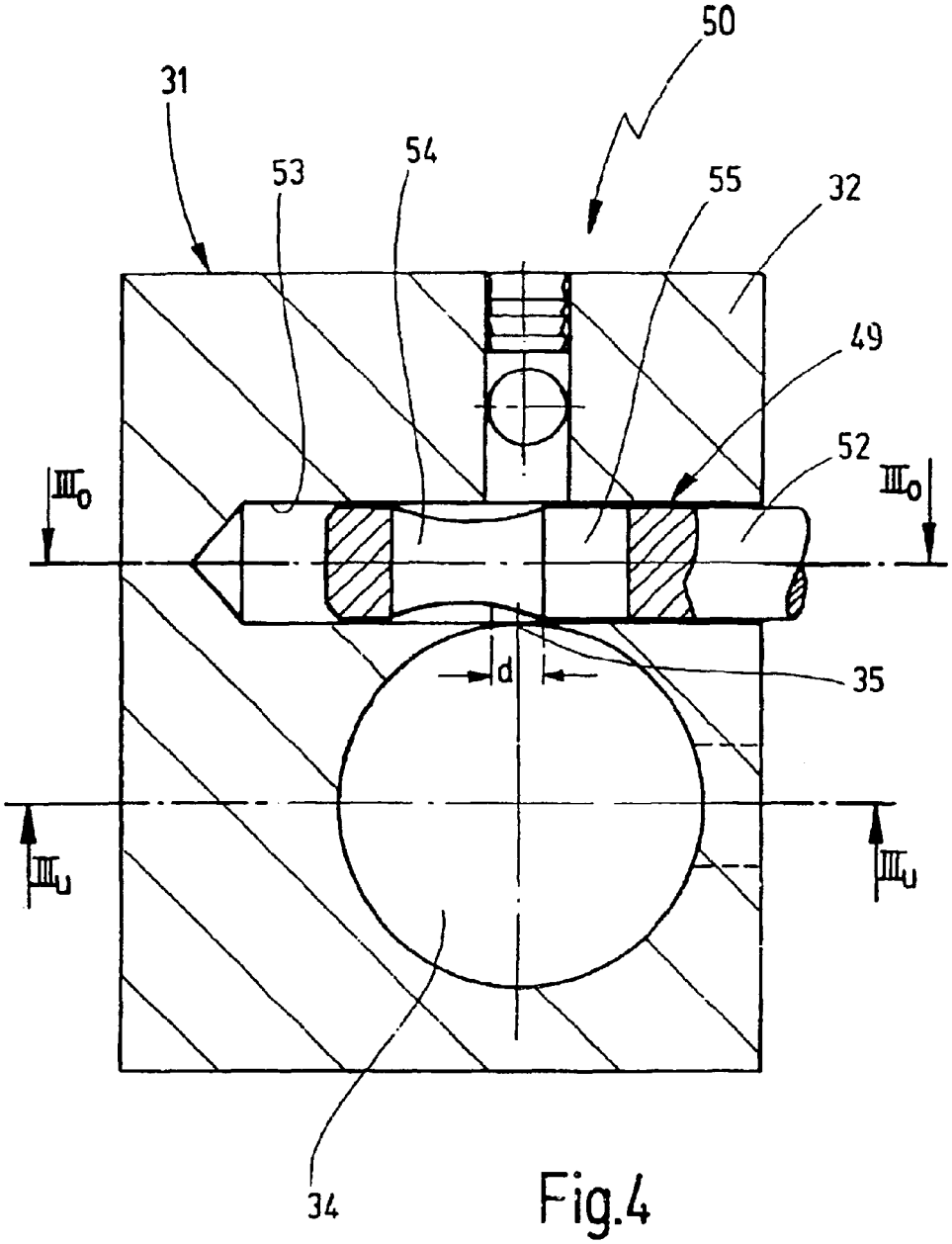
FIG. 4 shows a cross-sectional diagram of a section taken along line IV—IV in FIG. 3.

Damping element 31 and control unit 49 are integrated into actuator 16 in the case of valve brake 50, which is illustrated in FIG. 3 in two different longitudinal sections taken along cross-sectional lines $III_O$—$III_O$ and $III_U$—$III_U$ in FIG. 4, and is illustrated in FIG. 4 in a cross section taken along sectional line IV—IV in FIG. 3. Damping cylinder 32 is designed in one piece with cylinder housing 17 of actuator 16, and volume displacement chamber 34 is continued directly by second pressure chamber 20 of actuator 16. Damping piston 33 delimiting volume displacement chamber 34 is in turn designed in one piece with actuating piston 18 of actuator 16.

Control unit 49 for controlling the throttle cross section of throttle opening 35 has a throttle slide 52, which is axially displaceably accommodated in a guide bore 53 introduced into damping cylinder 32 across volume displacement chamber 34. Guide bore 53 is introduced in such a way that guide bore 53 intersects volume displacement chamber 34, thereby creating throttle opening 35 in chamber wall 341 of volume displacement chamber 34, this throttle opening being an oval having a width d, as seen in the direction of displacement of throttle slide 52 in the exemplary embodiment of FIGS. 3 and 4. Throttle slide 52 has a first through hole 54, extending across the slide axis and displaceable over throttle opening 35, and a second through hole 55, which is directly adjacent to the former and has a much smaller opening cross section than first through hole 54. First through hole 54 is designed as a bore and second through hole 55 is designed as an elongated hole. Throttle slide 52 is actuated by a gas volume which is exposed to the fluid temperature of the fluid displacement volume in volume displacement chamber 34. Therefore, a gas-filled diaphragm box 56 is mounted on damping cylinder 32 so that it has a heat-conducting connection to damping cylinder 32. Diaphragm box 56 has a hood-shaped, gas-filled container 58, which is covered by a diaphragm 59. Diaphragm box 56 is mounted on a base body 57 which is a good heat conductor and is attached to damping cylinder 32. Diaphragm 59 is clamped with a gastight seal at the edges between container 58 and base body 57 and is fixedly connected at the center to throttle slide 52.

If there is an increase in the temperature of the fluid in volume displacement chamber 34, the temperature of the gas volume in diaphragm box 56 also rises. The gas volume thereby increased causes displacement of throttle valve 52 via diaphragm 59, which results in a reduction in the cross section of throttle opening 35, through which the displacement volume displaced by damping piston 33 may flow out. The fluid flows out through the constriction in the throttle cross section at an increased temperature and an associated lower viscosity at approximately the same velocity as at a lower temperature and thus a higher viscosity, so the braking effect of valve brake 50 on valve element 12 is independent of the temperature, i.e., the viscosity, of the fluid in volume displacement chamber 34. An electric heating coil 60 is situated in the interior of diaphragm box 56, its heating current being adjustable by an electronic control unit 61. The heating of the gas volume, which takes place due to the heating of components, may be supported by extra electric heating to improve the response of valve brake 50.

Figure 5:
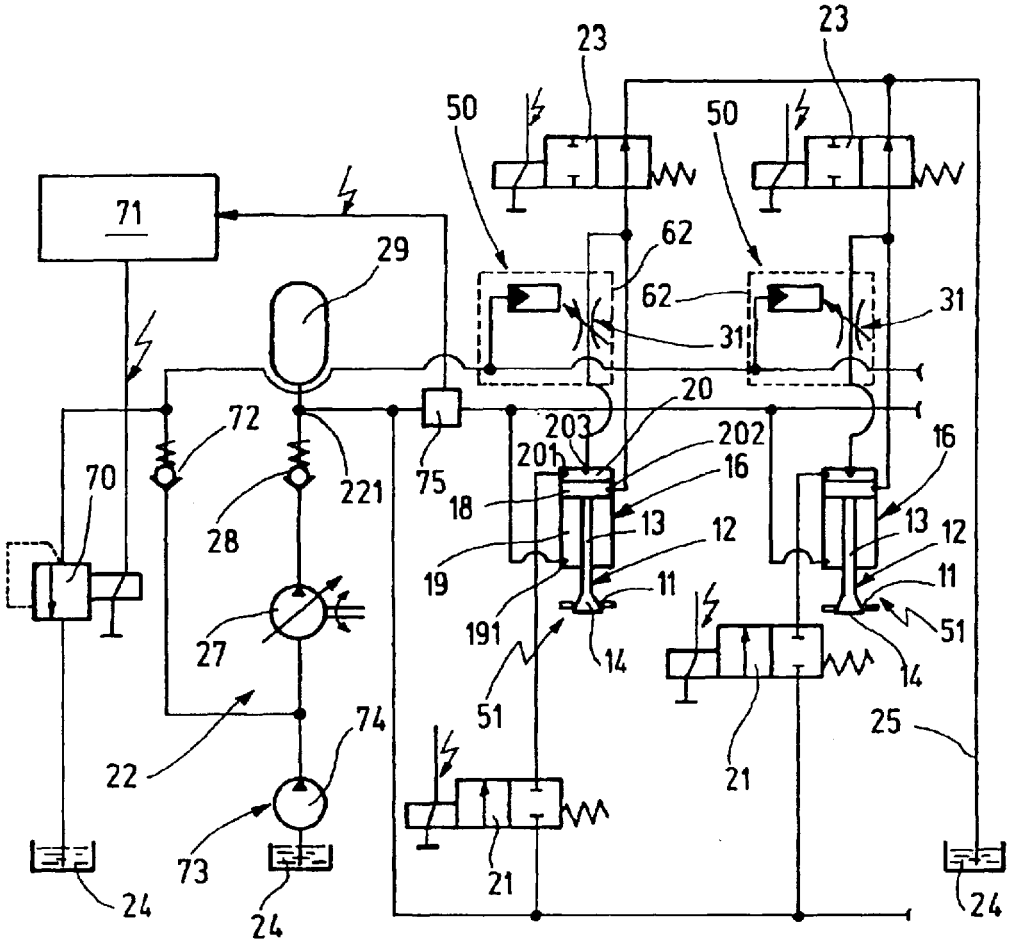
FIG. 5 shows a diagram of a device for controlling two opening cross-sections in an internal combustion engine according to another exemplary embodiment.

The device illustrated in FIG. 5 substantially corresponds to the device illustrated in FIG. 1, but FIG. 5 includes the control of two opening cross sections 11 in a combustion cylinder. The same parts shown in FIGS. 1 and 5 are therefore labeled with the same reference numbers. The number of controllable opening cross sections 11 and thus the number of gas exchange valves 51 assigned to them may be selected as desired. The device includes a modification in that valve brake 50 has a different function but it induces a reduction in the impact velocity of gas exchange valves 51 which is independent of the viscosity, i.e., the temperature, of the displacement volume in the same way.

Valve brake 50 has a hydraulic damping element 31 which is assigned to a gas exchange valve 51, i.e., its actuator 16, and has a fluid displacement volume that is displaced by a displacement piston and flows out through a throttle cross section of a throttle opening 35; valve brake 50 also has a control unit 49 which is shared by all gas exchange valves 51, i.e., actuators 16 thereof, for controlling the throttle cross section in damping elements 31 as a function of the viscosity of the displacement volume. Each hydraulic damping element 31 is integrated into one actuator 16, actuating pistons 18 at the same time also forming the damping pistons of damping elements 31. Fluid connections 201 and 202 of second pressure chamber 20 in each actuator 16 are designed so that actuating piston 18 seals fluid connection 202, which is connected to return line 25, after a predetermined closing stroke of valve element 12. Second pressure chamber 20 also has a third fluid connection 203 which, like fluid connection 201, cannot be closed by actuating piston 18. Third fluid connection 203 is connected to the valve inlet of second control valve 23 via a pressure-controlled throttle 62, this control valve still remaining connected to second fluid connection 202 of second pressure chamber 20.

Figure 6:
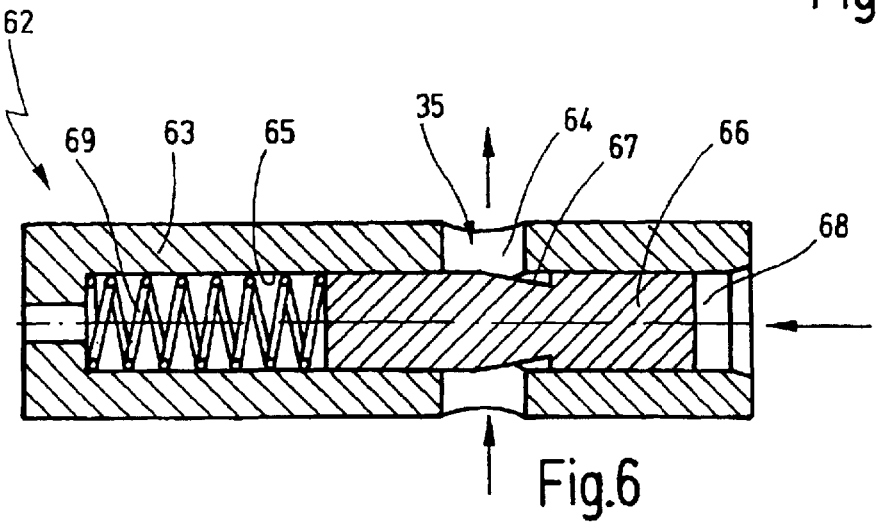
FIG. 6 shows a longitudinal cross-section of a controllable throttle in the device illustrated in FIG. 5.

Pressure-controlled throttle 62 is shown in a longitudinal cross-sectional view in FIG. 6. It has a cylindrical throttle body 63 which contains throttle opening 35 in the form of a diametric through hole 64. Through hole 64 intersects a blind hole-like longitudinal bore 65 in throttle body 63 in which a throttle element in the form of a control slide 66, which is axially displaceable in longitudinal bore 65 and which influences the throttle cross section of throttle opening 35 is arranged, so that it is displaceable longitudinally. Control slide 66 has a peripheral control edge 67 which cooperates with throttle opening 35 and whose one end face delimits a control pressure chamber 68 whose control pressure is adjustable by control unit 49. Between the base of longitudinal bore 65 and control slide 66 is supported a restoring spring 69, which is designed as a compression spring and, when control pressure chamber 68 is pressureless, moves control slide 66 to a basic position in which control slide 66 closes throttle opening 65. With an increase in the control pressure in control pressure chamber 68, control slide 66 is displaced to the left in FIG. 6, against the restoring force of restoring spring 69, thereby opening an increasing throttle cross section of throttle opening 35.

In addition to pressure-controlled control slides 66 which influence throttle openings 35, control unit 49 also has an electrically controlled hydraulic pressure valve 70, which adjusts the control pressure in all control pressure chambers 68 jointly, and an electronic control unit 71 which triggers pressure valve 70 and generates the control signals for pressure valve 70 as a function of the viscosity of the displacement volume. To generate a control pressure in control pressure chambers 68, both the control pressure chambers 68 and the valve inlet of pressure valve 70, which is designed here as a pressure-limiting valve, are connected by a joint non-return valve 72 to a pressure source 73, which supplies a maximum control pressure. Pressure source 73 is formed by a booster pump 74 for high-pressure pump 27, drawing in fluid from fluid reservoir 24 and conveying it to high-pressure pump 27 and to control pressure chambers 68 of pressure-controlled throttles 62 via return valve 72 and to pressure-limiting valve 70.

A viscosity sensor 75 is provided in the fluid supply circuit for actuators 16 of gas exchange valves 51 to detect the viscosity of the flowing fluid and send measurement signals to control unit 71. A first characteristic curve stored in control unit 71 describes the functional relationship between the hydraulic control pressure in control pressure chamber 68 and the throttle cross section of throttle opening 65, and a second characteristic curve also stored in control unit 71 describes the functional relationship between viscosity and hydraulic control pressure. On the basis of these characteristic curves and using the measured variables generated by viscosity sensor 75, control unit 71 generates the electric control signals for pressure-limiting valve 70. The amplitudes of the electric control signals are set so that the control pressure in control pressure chamber 68 decreases with a reduction in viscosity, and thus the throttle cross section of throttle opening 35 is reduced progressively.

In an alternative embodiment, instead of viscosity sensor 75, a temperature sensor may also be provided at the same location, its measurement signals again being supplied to control unit 71. In addition to the two characteristic curves already mentioned above, a third characteristic curve is also stored in control unit 71, describing the functional dependence of the viscosity of the fluid used on the temperature. The control signals are then also generated in control unit 71 by taking into account the third characteristic curve, the amplitudes of the electric control signals being adjusted so that the control pressure in control pressure chamber 68 decreases with an increase in temperature due to increasing control of pressure-limiting valve 70, and the throttle cross section of throttle opening 35 becomes restricted.

The present invention is not limited to the exemplary embodiments described above. For example, damping element 32 of valve brake 51 need not be integrated into actuator 16, and damping piston 33 need not be rigidly connected or joined in one piece to actuating piston 18 of actuator 16. Instead, damping piston 33 may also be fixedly connected directly to valve shaft 13 of valve element 12 or designed in one piece with it. In this case, damping cylinder 32 is provided with its own influx to supply a fluid volume which is cut off by damping piston 33 when the valve brake becomes operative. It is of course also possible to control a plurality of opening cross sections in a combustion cylinder using the device illustrated in FIG. 1 by providing each opening cross section with a gas exchange valve which is operated by an actuator in the manner described here.

What is claimed is:

1. A device for controlling at least one opening cross section in a combustion cylinder of an internal combustion engine, comprising:

a gas exchange valve positioned in the combustion cylinder and having a displaceable valve element with a valve shaft and a valve closure member formed on the valve shaft, the valve closure member cooperating with a valve seat surrounding the opening cross section;

an actuator that drives the valve element to execute an opening stroke that lifts the valve closure member up from the valve seat and a closing stroke that sets down the valve closure member on the valve seat;

a valve brake operative during a closing stroke of the valve element, the valve brake having a hydraulic damping element producing a fluid displacement volume that flows out through a throttle cross section of a throttle opening; and a control unit for controlling the throttle cross section as a function of a viscosity of the fluid displacement volume;

wherein the damping element has a damping cylinder, a damping piston fixedly connected to the lifting movement of the valve element and axially displaceable in the damping cylinder, and a volume displacement chamber fillable with a fluid, the volume displacement chamber being delimited by the damping piston and being connected to the throttle opening;

wherein the damping element is integrated into the actuator; and wherein:

the actuator has a double-acting working cylinder with a cylinder housing and an actuator piston displaceable within the cylinder housing, the actuator being fixedly connected to the valve shaft of the valve element and delimiting first and second pressure chambers in the cylinder housing, the first pressure chamber being acted upon by a fluid pressure, and the second pressure chamber having an inlet and a return, being acted upon by and relieved of the fluid pressure;

the damping cylinder is one piece with the cylinder housing;

the volume displacement chamber is in a fluid exchange connection with the second pressure chamber; and the damping piston is fixedly connected to the actuating piston in such a way that the damping piston seals the return after a predetermined closing stroke of the valve element.

2. The device according to claim 1, wherein the control unit controls the throttle cross section of the throttle bore to become smaller with a reduction in the viscosity of the displacement volume.

3. The device according to claim 1, wherein the fluid volume flowing out through the throttle cross section is sent to the return in the cylinder housing downstream from its opening into the second pressure chamber.

4. The device according to claim 1, wherein the damping piston is fixedly connected to the valve shaft of the valve element.

5. A device for controlling at least one opening cross section in a combustion cylinder of an internal combustion engine, comprising:

a gas exchange valve positioned in the combustion cylinder and having a displaceable valve element with a valve shaft and a valve closure member formed on the valve shaft, the valve closure member cooperating with a valve seat surrounding the opening cross section;

an actuator that drives the valve element to execute an opening stroke that lifts the valve closure member up from the valve seat and a closing stroke that sets down the valve closure member on the valve seat;

a valve brake operative during a closing stroke of the valve element, the valve brake having a hydraulic damping element producing a fluid displacement volume that flows out through a throttle cross section of a throttle opening; and a control unit for controlling the throttle cross section as a function of a viscosity of the fluid displacement volume;

wherein the damping element has a damping cylinder, a damping piston fixedly connected to the lifting movement of the valve element and axially displaceable in the damping cylinder, and a volume displacement chamber fillable with a fluid, the volume displacement chamber being delimited by the damping piston and being connected to the throttle opening; and wherein the control unit has a control piston which protrudes into the volume displacement chamber and a throttle pin which influences the throttle cross section of the throttle opening and is connected to the control piston so that the throttle cross section increases with increasing displacement of the control piston out of the volume displacement chamber.

6. The device according to claim 5, wherein the control piston and the throttle pin are coordinated so that at the operating temperature of the fluid, the size of the throttle cross section of the throttle opening is such that the fluid volume displaced out of the volume displacement chamber in the closing stroke of the valve element of the damping piston flows through the throttle cross section at a predetermined flow velocity.

7. The device according to claim 5, wherein the control piston is acted upon by the spring force of a restoring spring in a direction opposite to that of the direction of displacement of the control piston out of the volume displacement chamber.

8. The device according to claim 5, wherein the throttle opening is formed by an outlet bore which opens into the volume displacement chamber, the outlet bore having a guide bore passing through it transversely with the throttle pin displaceably accommodated therein, and the throttle pin has a transverse bore which, by its displacement, is insertable into an area of intersection of the outlet bore and the guide bore.

9. The device according to claim 8, wherein a second throttle opening is formed by a second outlet bore opening into the volume displacement chamber, and a second guide bore for a second throttle pin which is connected to the control piston passes through the second outlet bore transversely, and wherein the second throttle pin has a second transverse bore which is offset in a direction of displacement relative to the transverse bore in the first throttle pin and which enters into the area of intersection of the second outlet bore and the second guide bore with an offset relative to the transverse bore in the first throttle piston, due to displacement of the second throttle pin.

10. The device according to claim 9, wherein the first and second throttle pins and the control piston are parallel to one another and are joined by a crossarm, and the restoring spring is supported on the crossarm.

11. A device for controlling at least one opening cross section in a combustion cylinder of an internal combustion engine, comprising:

a gas exchange valve positioned in the combustion cylinder and having a displaceable valve element with a valve shaft and a valve closure member formed on the valve shaft, the valve closure member cooperating with a valve seat surrounding the opening cross section;

an actuator that drives the valve element to execute an opening stroke that lifts the valve closure member up from the valve seat and a closing stroke that sets down the valve closure member on the valve seat;

a valve brake operative during a closing stroke of the valve element, the valve brake having a hydraulic damping element producing a fluid displacement volume that flows out through a throttle cross section of a throttle opening; and a control unit for controlling the throttle cross section as a function of a viscosity of the fluid displacement volume;

wherein the damping element has a damping cylinder, a damping piston fixedly connected to the lifting movement of the valve element and axially displaceable in the damping cylinder, and a volume displacement chamber fillable with a fluid, the volume displacement chamber being delimited by the damping piston and being connected to the throttle opening; and wherein the throttle opening is situated in a chamber wall of the volume displacement chamber, and the control unit has a throttle slide displaceable by a gas volume which is exposed to the fluid temperature of the displacement volume, the throttle slide being displaced along the throttle opening so that the throttle cross section of the throttle opening becomes smaller in a direction of displacement of the throttle slide produced by an increase in the gas volume.

12. The device according to claim 11, wherein a guide bore introduced across the volume displacement chamber intersects the volume displacement chamber so that the throttle opening is formed in the chamber wall of the volume displacement chamber, and the throttle slide which is axially displaceably accommodated in the guide bore has a circular cross section and at least one through hole which extends across the axis of the slide and is displaceable over the throttle opening.

13. The device according to claim 12, wherein two through holes are provided in the throttle slide, a second through hole having a smaller opening cross section than a first through hole and being directly adjacent to the first through hole.

14. The device according to claim 11, wherein the gas volume is enclosed in a closed container which is in heat-conducting communication with the volume displacement chamber, the closed container having one of an elastically expandable and displaceable container wall fixedly connected to the throttle slide.

15. The device according to claim 14, wherein the container wall is formed by a diaphragm which is secured to the container at an edge and is connected centrally to the throttle slide.

16. The device according to claim 11, wherein the gas volume is additionally heatable.

17. The device according to claim 14, wherein an electric heating element is provided in the container, and wherein a heating current is adjustable by an electronic control unit.

18. A device for controlling at least one opening cross section in a combustion cylinder of an internal combustion engine, comprising:

a gas exchange valve positioned in the combustion cylinder and having a displaceable valve element with a valve shaft and a valve closure member formed on the valve shaft, the valve closure member cooperating with a valve seat surrounding the opening cross section;

an actuator that drives the valve element to execute an opening stroke that lifts the valve closure member up from the valve seat and a closing stroke that sets down the valve closure member on the valve seat;

a valve brake operative during a closing stroke of the valve element, the valve brake having a hydraulic damping element producing a fluid displacement volume that flows out through a throttle cross section of a throttle opening; and a control unit for controlling the throttle cross section as a function of a viscosity of the fluid displacement volume;

wherein the control unit has a pressure-controlled throttle element which varies the throttle cross section of the throttle opening, an electrically controlled hydraulic pressure valve which adjusts a control pressure on the throttle element, and an electronic control unit which triggers the pressure valve and generates control signals for the pressure valve as a function of the viscosity of the fluid displacement volume.

19. The device as recited in claim 18, further comprising a viscosity sensor which measures the viscosity of the fluid displacement volume, measurement signals of the viscosity sensor being sent to the control unit, wherein a first characteristic curve which describes a functional relationship between the throttle cross section of the throttle opening and the hydraulic control pressure on the throttle element is stored in the control unit along with a second characteristic curve which describes a functional relationship between the viscosity and the hydraulic control pressure, and the control signals for the pressure valve are generated on the basis of the first and second characteristic curves.

20. The device according to claim 18, further comprising a temperature sensor measuring a temperature of the fluid displacement volume, measurement signals of the temperature sensor being sent to the control, wherein a first characteristic curve which describes a functional relationship between the throttle cross section of the throttle opening and the hydraulic control pressure on the throttle element, a second characteristic curve which describes a functional relationship between the viscosity and the hydraulic control pressure, and a third characteristic curve which describes a functional relationship between the viscosity and temperature, are stored in the control unit, and the control signals for the pressure valve are generated on the basis of the first, second and third characteristic curves.

21. The device according to claim 18, the device controlling a plurality of opening cross sections in a combustion cylinder, wherein a plurality of actuators are provided to actuate corresponding gas exchange valves, wherein the damping element and the throttle element which varies its throttle opening are provided for each actuator, and the pressure valve for adjusting the control pressure is shared by all the throttle elements.

22. The device according to claim 18, wherein the pressure valve is an electrically controlled pressure-limiting valve which reduces a maximum control pressure prevailing on the throttle valve to a pressure level predefined by the control unit.

23. The device according to claim 18, wherein the throttle element is formed by an axially displaceable control slide having a control edge which controls the throttle cross section of the throttle opening, one end face of the control slide delimiting a control pressure chamber, and other end face of the control slide being supported on a restoring spring which displaces the control slide into a position in which the control slide closes the throttle cross section, and the control pressure chamber together with a valve inlet of the pressure-limiting valve is connected to a pressure source which supplies a maximum control pressure.

24. The device according to claim 23, wherein amplitudes of the electric control signals are adjusted in the control unit so that the control pressure in the control pressure chamber decreases with a decline in viscosity.

25. The device according to claim 23, wherein amplitudes of the electric control signals are adjusted in the control unit so that the control pressure in the control pressure chamber decreases with an increase in temperature.

26. The device according to claim 23, wherein the pressure source is a fluid pump which delivers a fluid out of a fluid reservoir.

27. The device according to claim 26, wherein the fluid pump is used as a booster pump for a high-pressure pump which supplies the actuator with a fluid under high pressure.

* * * * *